US008225625B2

(12) United States Patent
Heiden et al.

(10) Patent No.: US 8,225,625 B2
(45) Date of Patent: Jul. 24, 2012

(54) CHARM FOR CHAIN, CHAIN AND CHAIN ELEMENT PROVIDED WITH SUCH A CHARM

(75) Inventors: Kent Heiden, Oleta, CA (US); Gielen Kris, Lummen (BE)

(73) Assignee: Timebeads, LLC, Goleta, CA (US)

( * ) Notice: Subject to any disclaimer, the term of this patent is extended or adjusted under 35 U.S.C. 154(b) by 964 days.

(21) Appl. No.: 12/212,120

(22) Filed: Sep. 17, 2008

(65) Prior Publication Data

US 2009/0260394 A1 Oct. 22, 2009

(30) Foreign Application Priority Data

Apr. 16, 2008 (BE) ..... 2008/0230

(51) Int. Cl.
*A44C 5/00* (2006.01)

(52) U.S. Cl. ..... 63/3; 63/23

(58) Field of Classification Search ..... None
See application file for complete search history.

(56) References Cited

U.S. PATENT DOCUMENTS

| | | | | |
|---|---|---|---|---|
| 4,353,124 | A * | 10/1982 | Weinzettel et al. | 368/258 |
| 6,130,861 | A * | 10/2000 | Della Felice | 368/276 |
| 7,007,507 | B2 | 3/2006 | Enevoldsen | |

FOREIGN PATENT DOCUMENTS

| | | |
|---|---|---|
| CH | 328 140 | 2/1958 |
| DE | 295 169 | 5/1916 |
| DE | 100 27 118 | 12/2001 |
| FR | 2 429 571 | 1/1980 |
| GB | 15649 | 0/1908 |
| GB | 2 195 793 | 4/1988 |

* cited by examiner

*Primary Examiner* — Jack W. Lavinder
(74) *Attorney, Agent, or Firm* — Cislo & Thomas, LLP

(57) ABSTRACT

Charm (1) for a chain (3) and/or ribbon and/or belt in the form of a necklace, a bracelet or the like, characterized in that this charm (1) is provided with a time-rendering device (2).

9 Claims, 6 Drawing Sheets

CHARM FOR CHAIN, CHAIN AND CHAIN ELEMENT PROVIDED WITH SUCH A CHARM

The present invention concerns a charm for a chain, a chain and a chain element provided with such a charm.

In particular, the invention is intended for a chain in the form of a bracelet, a necklace or the like.

Such chains can be made of all sorts of materials such as for example metal, plastic, leather, wood, yarn or any other suitable material whatsoever.

Charms in the form of all sorts of figures and shapes with which a bracelet is given an exclusive and distinctive look and as a result of which said bracelet distinguishes itself from an ordinary bracelet without any charms, thus making the bracelet more unique to the user, are already known.

The known charms are made of stainless steel, silver, gold or the like, and they either or not make use of precious stones, fancy glass or wooden beads and the like having rather small dimensions, usually having a diameter smaller than 25 mm, preferably between 5 and 20 mm.

The above-mentioned charms enable the user to continuously change his/her looks by selecting charms and by providing them to a bracelet, a necklace or the like.

If the user wishes to do so, several charms according to different themes, in different materials, with different ornaments and the like can be provided to a single chain.

An example of such a chain with charms has been described in U.S. Pat. No. 7,007,507, whereby the chain is provided with means to restrict the movement of the provided charms, such that the charms do not gather around a single point of the chain, but remain nicely distributed over the chain.

These means can be made in all sorts of shapes and they are not only practical, but they can also confer additional character to the chain.

Charms which are fixed to the bracelet and which are hence selected by the manufacturer and not by the user are known as well.

When manufacturing such bracelets, a new charm or a new set of charms must be made for every new type of bracelet, which leads to relatively high production costs.

Further, it is known that people wearing a bracelet around one wrist, may wear a watch around the other wrist, which is disadvantageous in that the watch cannot be matched with the bracelet.

Another disadvantage is that the watch-strap cannot be easily replaced, such that it is not practical and moreover time-consuming to select a different watch-strap every day as a function of for example the clothes one is wearing or the activities one will carry out.

The present invention aims to remedy one or several of the above-mentioned and/or other disadvantages by providing a charm for a chain and/or ribbon and/or belt in the form of a necklace, a bracelet or the like, whereby the above-mentioned charm is provided with a time-rendering device.

In a practical embodiment of the invention, the charm is provided with a fixing element having an assembly opening, whereby the above-mentioned fixing element can be provided around the above-mentioned chain in a detachable or permanent manner by means of the above-mentioned assembly opening.

Naturally, charms which are provided with a time-rendering device can be assembled in many different ways.

However, there are five preferred embodiments of the invention, whereby the fixing element is formed of a threaded connection in the first embodiment, of an opening with internal screw thread in a second embodiment, of a hinged element in a third embodiment, of a permanent connection in a fourth embodiment, and of a hole with no hinge or no threaded connection in a fifth embodiment, which embodiments all provide a solution to one or several of the above-mentioned disadvantages.

The different assembly possibilities provide the user with an endless range of possible charms to choose from, provided with a time-rendering device, which are complementary to and can be added to other charms, as described above, and which are all attached to one and the same bracelet.

The user can express him/herself via these charms and change the looks, the color and the expression of the bracelet in a simple manner by means of the charms, either or not provided with a time-rendering device.

An advantage is that the charm is provided with a time-rendering device, and consequently functions as a watch, such that there is no need to wear a separate watch, which is cost-saving.

An additional advantage is that such a charm which is provided with a time-rendering device is easy to manufacture by producers of jewels and watches.

According to a preferred characteristic of the invention, the charm is provided with a fixing element with an assembly opening, and the above-mentioned fixing element is provided round the above-mentioned chain in a detachable manner by means of the above-mentioned assembly opening.

An advantage is that a charm which is provided with a time-rendering device, just like any other charm, can be easily replaced according to the user's taste, activities and the like.

An additional advantage is that every new type of charm which is provided with a time-rendering device can be fixed around an existing bracelet by means of the assembly opening, as a result of which the bracelets can be manufactured in larger series, leading to savings in the production costs.

The present invention concerns a chain formed of two chain elements which can be connected by means of a lock, whereby at least one of the above-mentioned chain elements is provided with a charm provided with a time-rendering device, whereby the charm can be connected to at least one other chain element in a permanent or detachable manner by means of connecting means provided to that end, whereby the above-mentioned connecting means are formed of an outside thread in the above-mentioned chain element and an opening with internal screw thread provided on the above-mentioned charm.

The present invention also concerns a chain element provided with a charm whereby the charm is provided with a time-rendering device and the chain element is provided with connecting means made in the shape of a threaded connection.

An advantage is that, as the chain has already been provided with a charm with a time-rendering device, the bracelet or the necklace is functional and thus costs can be saved.

An advantage is that the design of the chain allows for mass production of the chain elements, resulting in reduced production costs.

Another advantage is that the charm with the time-rendering device can be easily produced in different variants and that the user can provide one or several of said charms to the chain as desired, depending on his/her preferences, activities or the like.

In order to better explain the characteristics of the invention, the following preferred embodiments of a charm and chain according to the invention are described as an example only without being limitative in any way, with reference to the accompanying drawings, in which:

FIG. 1 schematically represents a chain in perspective with a charm according to the invention, which is provided with a time-rendering device;

Figure 1:
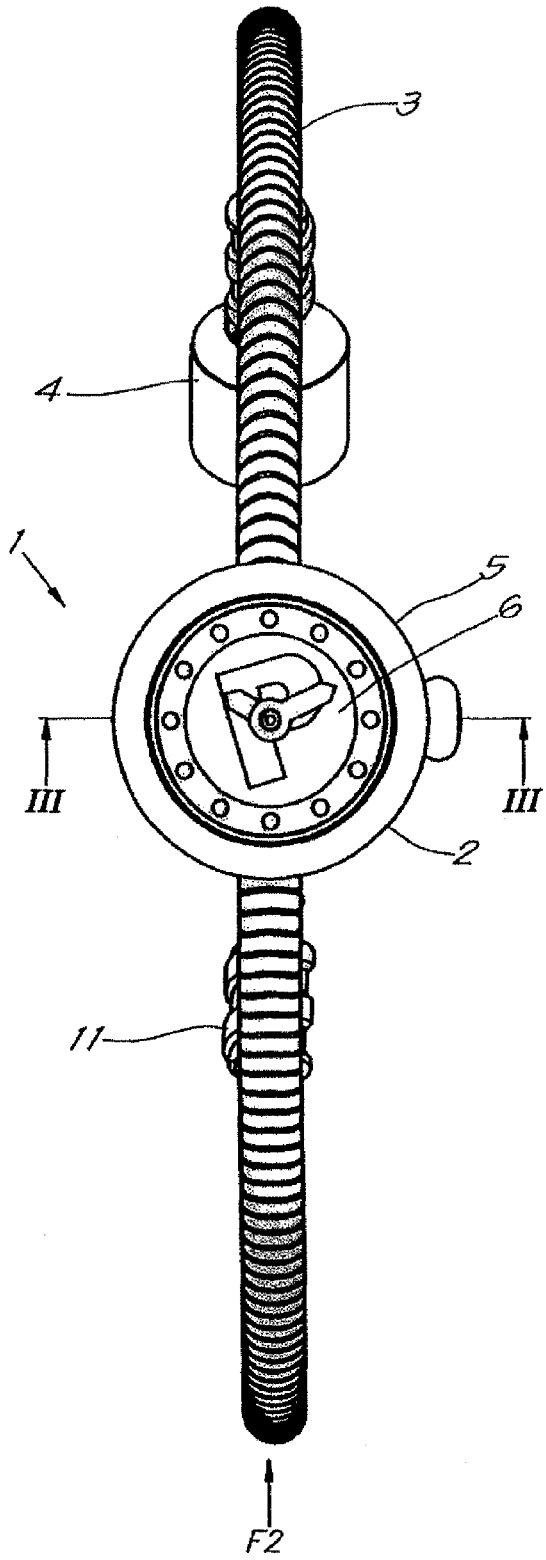

FIG. 1 schematically represents a charm 1 according to the invention whereby the charm 1 is provided with a time rendering device 2.

In the embodiment shown, the above-mentioned charm I is provided on a chain 3, and the chain 3 is made in the shape of a bracelet by way of example.

In the embodiment shown, the chain 3 is made as a continuous strap, but it can also be made as a series of several links or in the shape of a belt or a ribbon or the like.

Although the embodiments in the figures always represent the chain 3 in the shape of a bracelet, it is not excluded to make the chain 3 in the shape of an anklet, a necklace or the like.

Further, the chain 3 is provided with conventional means 4 which make it possible to open and close the chain 3 so that the chain 3 can be easily put around the arm, the neck or the like.

The chain 3 can be fixed to the charm 1 provided with a time-rendering device 2, either permanently or in a detachable manner, by means of different assembly openings which will be discussed hereafter.

According to a characteristic of the invention, the charm 1 is provided with a time-rendering device 2, which is in this case made as a circular base 5 in the conventional manner, with a dial on top over which has been provided a display window 6, but the time-rendering device 2 may have any other shape whatsoever of course, such as for example a rectangular shape, a heart shape or the like, and the dial may also be replaced by a digital display window.

According to a preferred characteristic of the invention, the dimensions of the above-mentioned display window 6 are smaller than 25 mm, preferably even smaller than 20 mm.

The charm 1 is preferably provided with a fixing element 7 with an assembly opening 8, and the above-mentioned fixing element 7 is provided around the chain 3 in a detachable manner by means of the above-mentioned assembly opening 8.

The above-mentioned assembly opening 8 extends through said fixing element 7, such that the charm 1, which is provided with a time-rendering device 2, can be moved from a first chain element 9 to a second chain element 10 by screwing or turning the above-mentioned charm 1 over an element 11 with an outside thread, and such that the above-mentioned charm 1 can shift over the chain 3 between two successive elements with outside thread 11.

The chain 3 extends through the above-mentioned fixing element 7.

Figure 2:
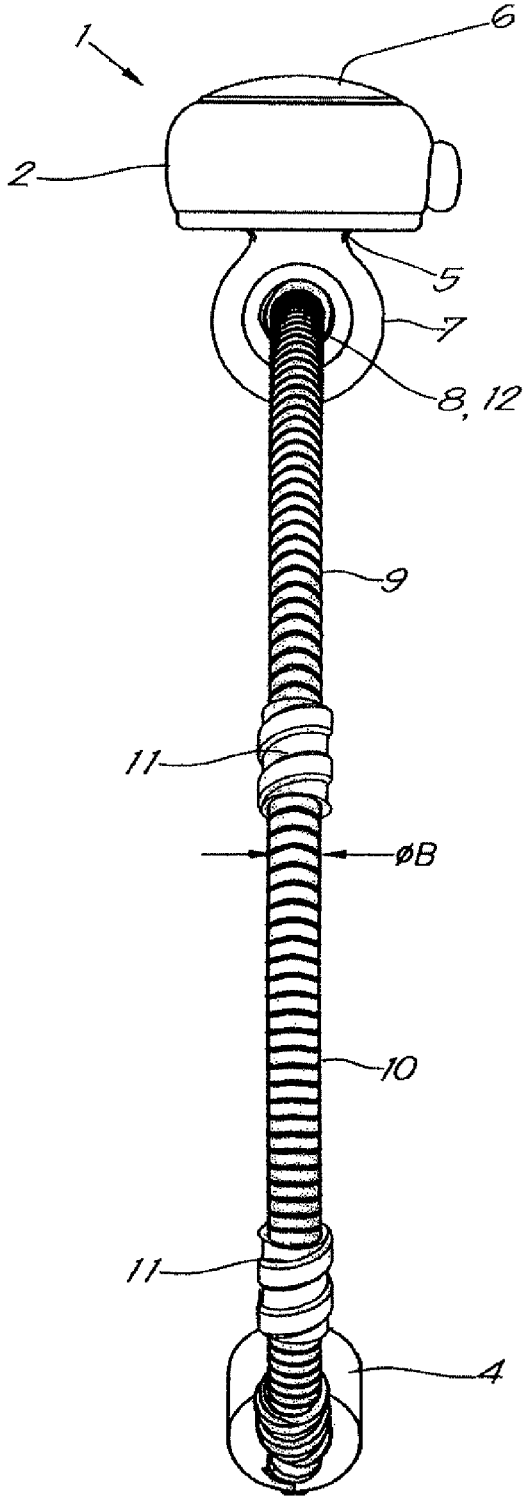
FIG. 2 represents a view according to arrow F2 in FIG. 1.
Figure 3:
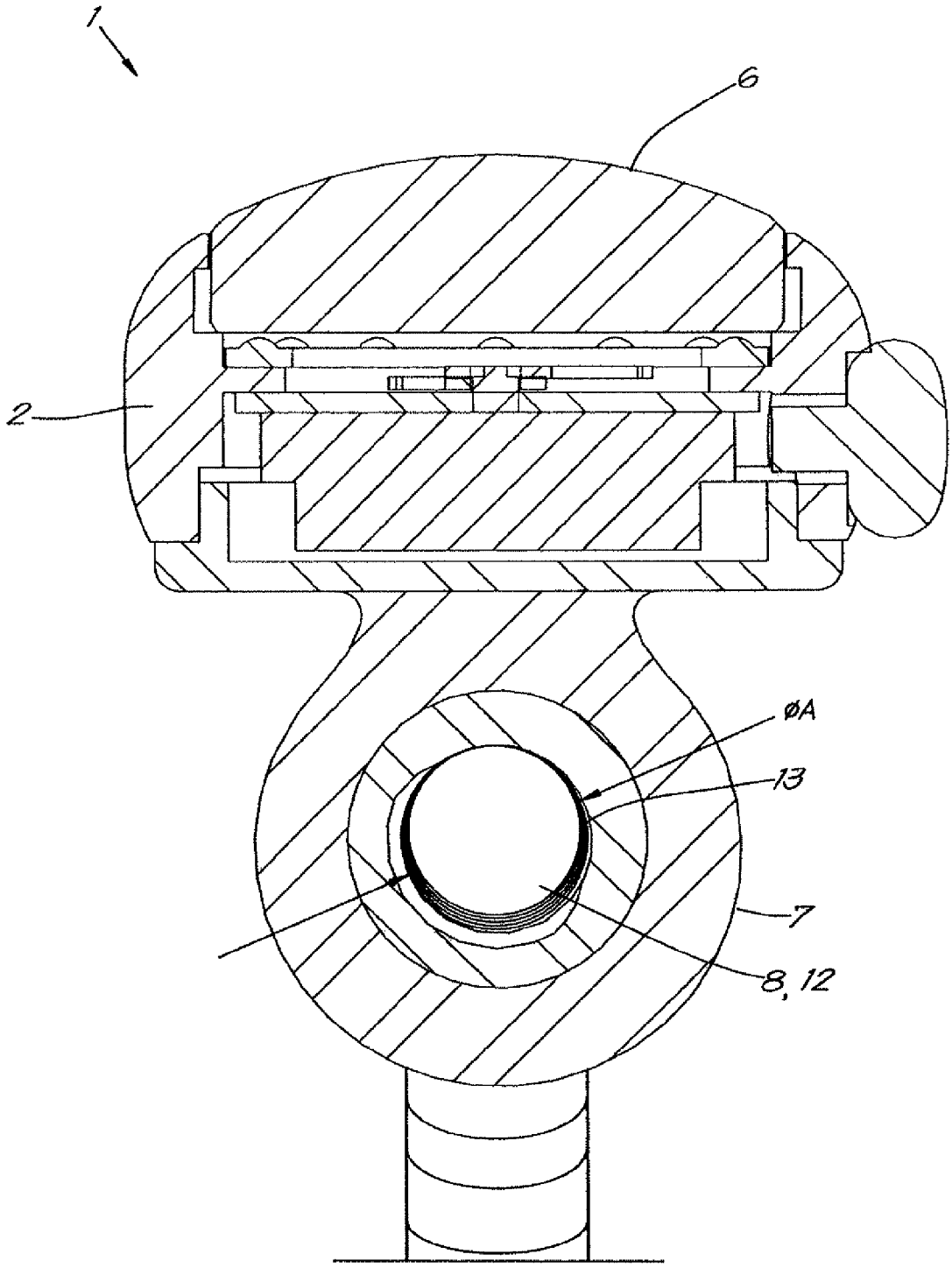
FIG. 3 represents a section according to line III-III in FIG. 2 and shows the charm in greater detail, whereby the charm is provided with a time-rendering device and is provided with an assembly opening with internal screw thread.

In the embodiment shown in FIGS. 1 to 3, said fixing element 7 is provided at the bottom of the time-rendering device 2, but it is not excluded for this fixing element 7 to be provided in another place on the charm 1 with the time-rendering device 2.

In a preferred embodiment, the assembly opening 8 is provided with a diameter A which is practically equal to or larger than the diameter B of the cross section of the chain 3, such that the above-mentioned charm 1 can shift over the chain 3 in the area between two successive elements 11 with outside thread.

In the embodiment of FIGS. 1 to 3, the fixing element 7 has the shape of a closed ring 12, such that the chain 3 can he pushed through the recess of the above-mentioned ring 12.

In a practical embodiment of the invention, the fixing element 7 may consist of a closed ring 12, whereby the above-mentioned ring 12 comprises an assembly opening with thread 13.

Although the figures represent a circular recess in the assembly opening 8, it is not excluded for the recess to be made in another shape.

The assembly opening 8 is preferably provided with an internal screw thread 13 with which the above-mentioned charm 1 can be screwed on or past an element 11 with outside thread, whereby the above-mentioned element 11 is part of the chain 3.

According to a special characteristic of the invention, the above-mentioned charm 1 can be attached in a fixed spot by co-operating with the above-mentioned element 11.

The method for applying a charm is very simple, as the user can thread a chain 3 with one far end through the recess of the assembly opening 8.

Figure 4:
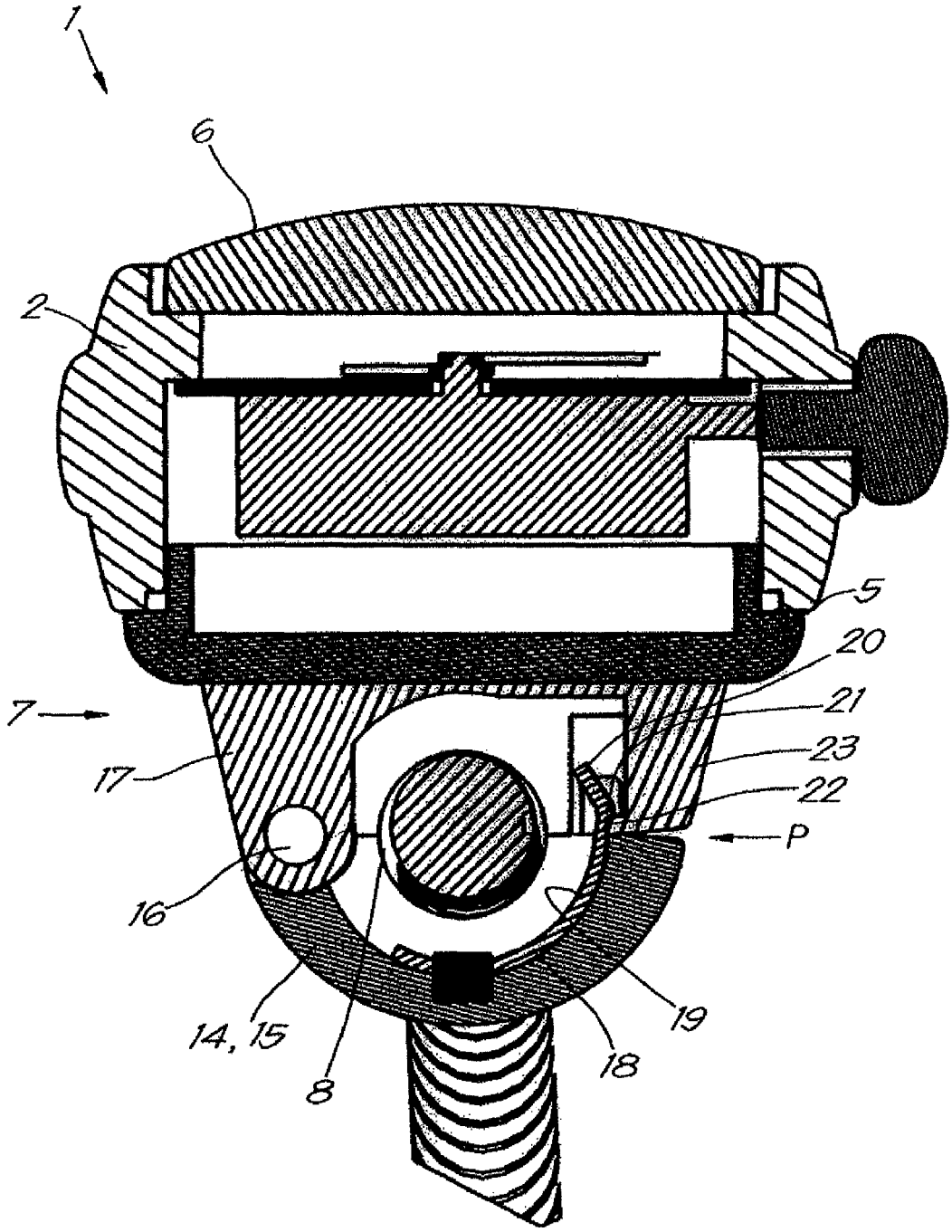
FIG. 4 represents the section of FIG. 3 in an alternative embodiment whereby the charm, which is provided with a time-rendering device, is provided with an assembly opening comprising a hinged part.

FIG. 4 shows a section of an alternative embodiment of a charm 1 provided with a time-rendering device 2, whereby the fixing element 7 of the above-mentioned charm 1 is provided with a part 14 which can move between an open position in which the chain 3 can be put in the assembly opening 8 and a closed position in which the chain 3 can be radially set in the above-mentioned assembly opening 8.

The moving part 14 is preferably hinged so as to close and open the above-mentioned assembly opening 8.

The above-mentioned fixing element 7 can be fixed to the chain 3 in such a way that the charm 1 can freely shift over the chain 3 between two elements 11 or it can be firmly fixed to an element 11 with outside thread.

In a preferred embodiment, the above-mentioned moving part 14 is made in the shape of an arm 15, preferably made of a light deformable material, and it is hinge-mounted to the bottom of the time-rendering device 2, whereby the arm 15 at least partly confines the assembly opening 8 in the closed position.

In the embodiment shown in FIG. 4, the hinge point 16 of the arm 15 is fixed to one far end of a first protruding element 17 situated at the bottom of the time-rendering device 2, whereby this protruding element 17 confines a part of the assembly opening 8; however, the arm 15 can also be directly connected to the charm 1.

Although FIG. 4 shows an arched arm 15, it is not excluded to realize the arm 15 in a different shape, such that the assembly opening 8 is not made circular but rectangular, for example.

According to a preferred characteristic of the invention, the above-mentioned arm 15 is provided with locking means 18 which can lock the arm 15 in the closed position.

These locking means 18 are preferably made as a leaf spring 19 provided on the above-mentioned arm 15 and extending with one part 20 past the free end of said arm 15.

On the above-mentioned part 20 of the leaf spring 19 is provided a lip 21 which can work in conjunction with an edge 22 which in this case has been provided on a second protruding element 23 at the bottom of the time-rendering device 2.

The lip 21 of the above-mentioned leaf spring 19 will preferably mesh behind the above-mentioned edge 22 as the arm 15 moves from the open into the closed position.

The method for applying a charm 1 according to the invention to a chain 3 is very simple and as follows.

In the position represented in FIG. 4, the arm 15 of the charm 1, which is provided with a time-rendering device 2, is turned clockwise around the hinge point 16, such that the chain 3 can be provided in the assembly opening 8.

When the chain 3 has been provided in the opening 8, the arm 15 can be put in the closed position again by making the arm 15 turn anti-clockwise around the hinge point 16.

When the arm 15 is almost in the closed position, the lip 21 of the leaf spring 19 will reach the edge 22 of the above-mentioned charm 1 and, as a result, it will be pushed in the direction of the chain 3, and as the arm 15 is rotated further around the hinge point 16, the lip 21 will mesh behind said edge 22, after which the arm 15 will be situated in the above-mentioned closed position.

In order to remove the above-mentioned charm 1, the user will exert a force on the far end of the arm 15 according to arrow P in FIG. 4, as a result of which the lip 21 can no longer mesh behind the edge 22 on the charm 1 and the arm 15 can be turned clockwise around the hinge point 16, such that the fixing element 7 can be put in the open 30 position and the chain 3 can be simply removed from the assembly opening 8.

Figure 5:
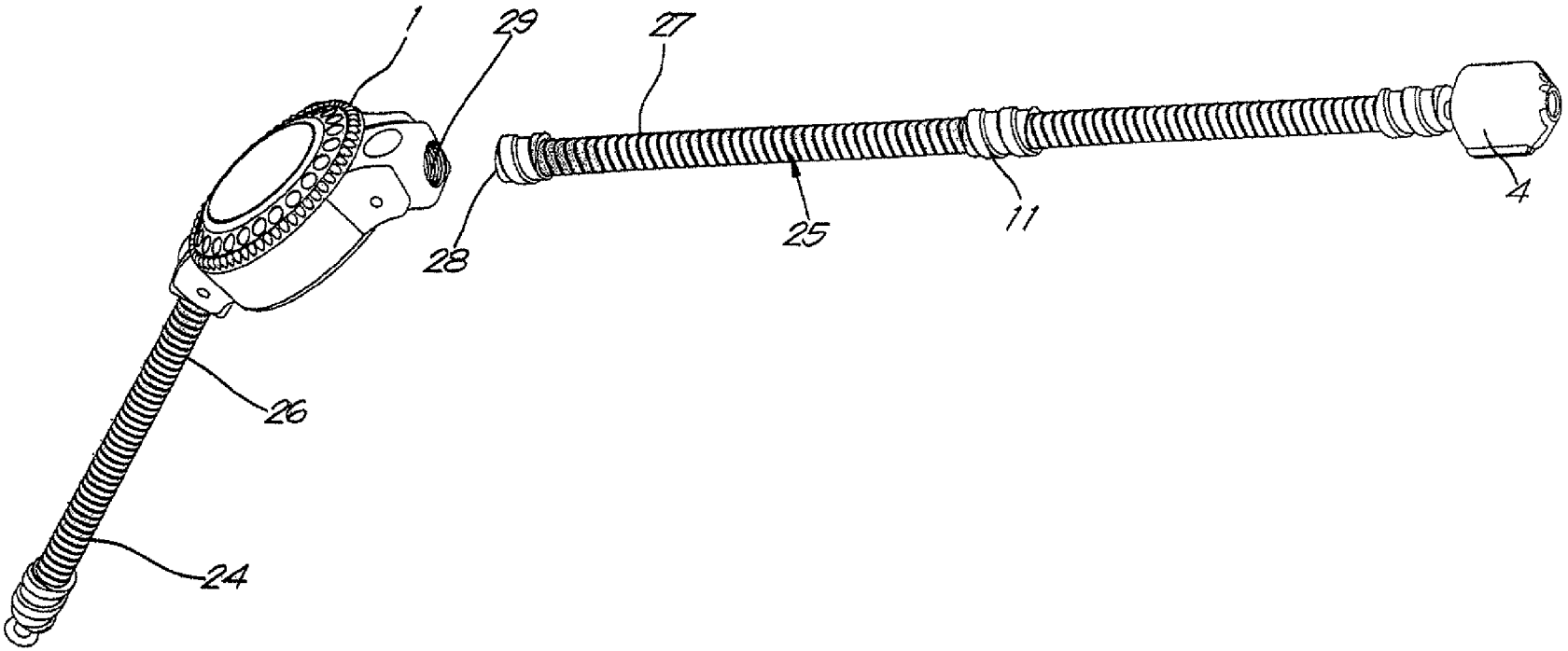
FIG. 5 is an exploded view of a chain with a charm according to the invention, whereby the chain comprises two elements, one chain element of which is connected to a charm in a detachable manner, whereby the charm is provided with a time-rendering device and with an assembly opening with internal screw thread.

FIG. 5 shows an alternative embodiment of a chain 3 with a charm 1 according to the invention whereby the charm 1 comprises a time-rendering device 2.

The chain 3 comprises two chain elements 24-25, a first element 24 and a second chain element 25 respectively, which can be connected to one another by means of a known lock 4.

In the embodiment shown, a charm 1 is provided on one far end 26 of the first chain element 24, whereby this charm 1 comprises a time-rendering device 2.

In the given example, the charm 1 is fixed to the first chain element 24 in a non-detachable manner, for example by soldering this first chain element 24 to the above-mentioned charm 1.

However, it is not excluded according to the invention to fix the above-mentioned charm 1 in a detachable manner to the chain 3, for example by means of connectors.

The above-mentioned charm 1 is in this case connected in a detachable manner to a far end 27 of the second chain element with connecting means which are preferably made in the shape of a threaded connection, whereby the above-mentioned connecting means are formed of an outside thread 28 on the above-mentioned chain element 25 and an opening 29 with internal screw thread provided on the above-mentioned charm 1.

In the given embodiment, the above-mentioned charm 1 is connected to respective chain elements 24-25 at two diametrically opposed connection points.

It is not necessary according to the invention for the chain 3 to comprise only two chain elements 24,25; on the contrary, it may also comprise more than two chain elements which are provided for example with a cavity with internal screw thread at one far end and with an outside thread at their other far end, such that chain elements can be coupled to one another by means of these threads.

According to a preferred characteristic of the invention, the threaded connection, formed of an outside thread, is provided on an element 11 of the above-mentioned chain element 25 and an opening 29 with internal screw thread provided in the above-mentioned charm 1.

The connections between the charm 1 and the second chain element 25 and between the mutual chain elements 24-25 must not necessarily be made as threaded connections; on the contrary, they can also be made as any other form of detachable connecting means.

The method for applying and removing a charm 1 to and from a chain 3 according to FIG. 5 is very simple as one far end 27 of the second chain element 25 can be unscrewed or screwed down in the charm 1.

Figure 6:
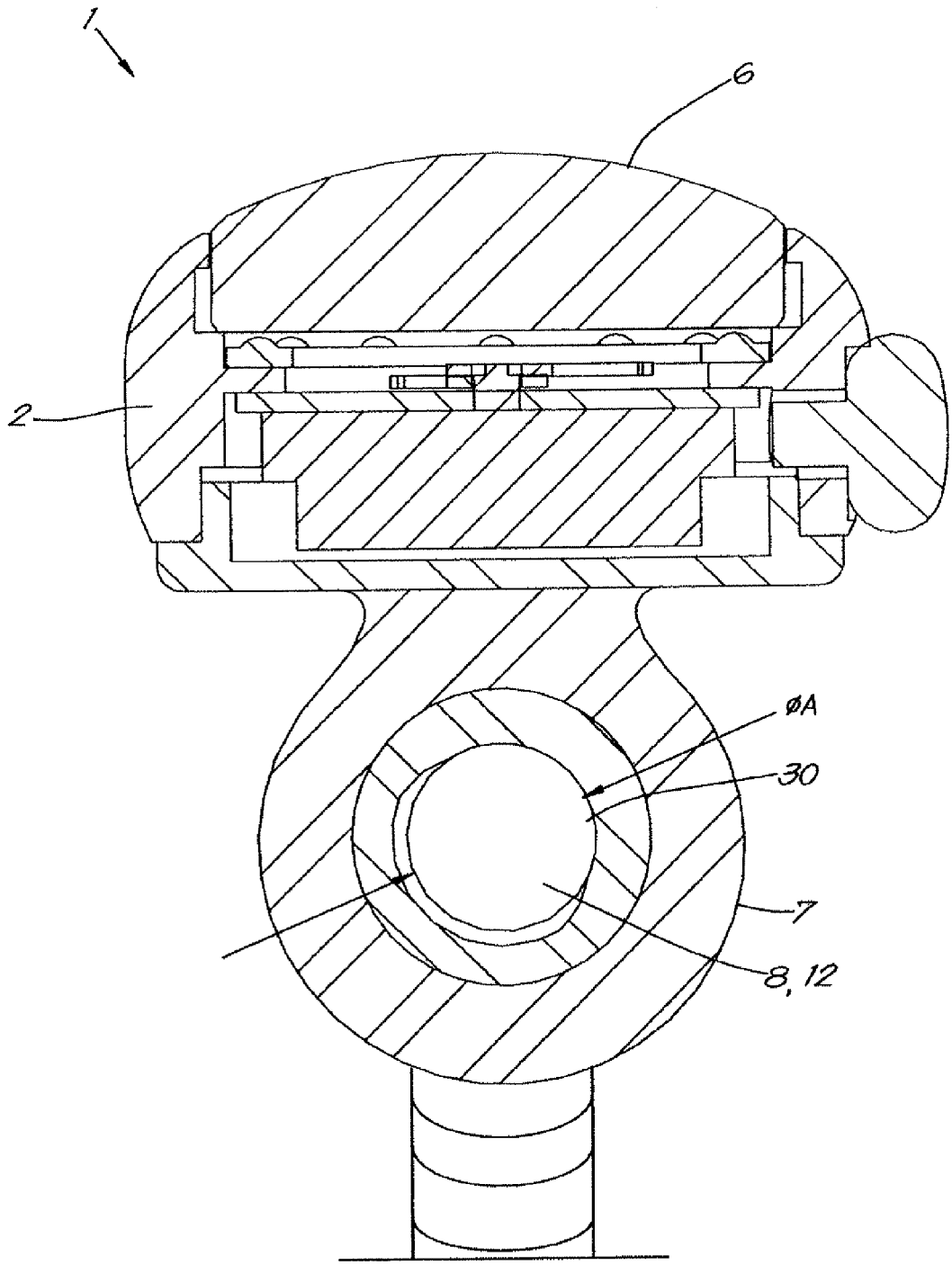
FIG. 6 represents the section of FIG. 3 in an alternative embodiment whereby the charm is provided with a time-rendering device and is provided with an assembly opening comprising a hole without internal screw thread.

In the embodiment of FIG. 6, the fixing element 7 has the shape of a closed ring 12, such that the chain 3 can be pushed through the recess of the above-mentioned ring 12.

In a practical embodiment of the invention, the fixing element 7 may consist of a closed ring 12, whereby the above-mentioned ring 12 comprises a smooth assembly opening 30 and without any thread.

The present invention is by no means restricted to the embodiments described as an example and represented in the drawings; on the contrary, a charm 1, a chain 3 and a chain element according to the invention can be made in all sorts of variants while still remaining within the scope of the invention.

What is claimed is:

1. A jewelry article, comprising:

a charm; and a fixing element below the charm; the fixing element having an assembly opening, the fixing element being mountable around a necklace or a bracelet in a detachable manner, thereby, locating the necklace or bracelet in the assembly opening, wherein the fixing element includes a part moveable between an open position and a closed position, the fixing element comprising an internal screw thread, wherein in the open position the necklace or bracelet can be disposed in the assembly opening, and in the closed position the necklace or bracelet is set in the assembly opening in such a way as to allow the charm to freely shift over the necklace or bracelet, and wherein the necklace or bracelet comprises a second element having an outside screw thread configured such that when the second element is disposed within the fixing element when the fixing element is in the closed position, the charm is firmly fixed in place on the second element, but enabled to be screwed on or past the second element while still in the closed position.

2. The jewelry article according to claim 1, wherein the assembly opening has a diameter which is practically equal to or larger than the diameter of the cross section of the chain.

3. The jewelry article according to claim 1, wherein the charm includes a display window whose dimensions are smaller than 25 mm.

4. The jewelry article according to claim 1, wherein the moving part hinges in order to close and open the assembly opening.

5. The jewelry article according to claim 1, wherein the moving part is made in the shape of an arm which is hinge-mounted to the time-rendering device and the arm at least partly confines the assembly opening in the closed position.

6. The jewelry article according to claim 5, wherein the arm is provided with a locking arrangement which enables locking of said arm in the closed position.

7. The jewelry article according to claim 6, wherein the locking arrangement includes a leaf spring on which is provided a lip, said lip meshing behind an edge of the time-rendering device when the arm moves from the open into the closed position.

8. The jewelry article of claim 1, wherein the charm further comprises a time rendering device.

9. The jewelry article of claim 8, wherein the time rendering device includes a display window whose dimensions are smaller than 25 mm.

* * * * *